United States Patent [19]

Higgins

[11] Patent Number: 4,908,496

[45] Date of Patent: Mar. 13, 1990

[54] RADIANT ELECTRIC HEATER ASSEMBLIES

[75] Inventor: George A. Higgins, Hagley, United Kingdom

[73] Assignee: Micropore International limited, Worcestershire, United Kingdom

[21] Appl. No.: 232,783

[22] Filed: Aug. 16, 1988

[30] Foreign Application Priority Data

Aug. 25, 1987 [GB] United Kingdom ..... 8720054

[51] Int. Cl.[4] ..... H05B 1/02

[52] U.S. Cl. ..... 219/464; 219/446; 219/449; 219/452

[58] Field of Search ..... 219/464, 446, 448, 449, 219/451, 452, 458, 459, 461

[56] References Cited

U.S. PATENT DOCUMENTS

| | | | |
|---|---|---|---|
| 2,201,584 | 5/1940 | Kahn | 219/446 |
| 4,511,789 | 4/1985 | Goessler | 219/446 |
| 4,538,051 | 8/1985 | SSchreder | 219/464 |
| 4,700,051 | 10/1987 | Goessler | 219/464 |

FOREIGN PATENT DOCUMENTS

| | | | |
|---|---|---|---|
| 2153555B | 1/1984 | United Kingdom . | |
| 2148678 | 5/1985 | United Kingdom | 219/460 |

*Primary Examiner*—Teresa J. Walberg
*Attorney, Agent, or Firm*—Browdy and Neimark

[57] ABSTRACT

A radiant electric heater assembly for a glass ceramic top cooker includes four radiant electric heating elements and a thermal cut-out device. Associated with the termal cut-out device is a switching device for connecting the four heating elements in parallel with each other to give a first power level setting and for connecting the heating elements in a lower power configuration in which the elements are connected as two elements connected in series with each other and connected in series with a pair of elements connected in parallel with each other. When the thermal cut-out device detects a first predetermined temperature the heating elements are connected in the lower power configuration until such time as the thermal cut-out device detects a second predetermined temperature, lower than the first predetermined temperature, when the heating elements are reconnected in the configuration of the first power level setting.

4 Claims, 4 Drawing Sheets

| Power Level \ Switch | 22 | 23 | 24 | 25 | 26 | 27 | 28 |
|---|---|---|---|---|---|---|---|
| 1 | x | | | | | | |
| 2 | x | | | | x | | |
| 3 | | | x | | | x | |
| 4 | | | x | | x | x | |
| 5 | x | | | x | x | | x |
| 6 | | x | x | x | x | | x |

x = Switch closed

FIG 5

RADIANT ELECTRIC HEATER ASSEMBLIES

FIELD OF THE INVENTION

The present invention relates to radiant electric heater assemblies such as may be used in electric cookers having a glass ceramic cooking surface.

DESCRIPTION OF PRIOR ART

Radiant electric heater assemblies are known which comprise a metal dish containing a base layer of thermal and electrical insulating material, a peripheral wall of insulating material and a plurality of heating elements. The heating elements may be of bare resistance wire or may be in the form of infra-red lamps. A thermal cut-out device is provided to disconnect all power to the heating elements in the event of overheating so as to protect the glass ceramic surface from discoloration or even breakage and avoid heater failure. However, in certain modes of operation the thermal cut-out device can operate so frequently that the service life of the heater assembly may be reduced. In addition the operation of the cut-out and the complete de-energisation of the heater may create the impression that the heater has malfunctioned.

OBJECT OF THE INVENTION

It is an object of the present invention to provide a radiant electric heater assembly which alleviates these problems.

SUMMARY OF THE INVENTION

According to the present invention there is provided a radiant electric heater assembly for a glass ceramic top cooker comprising:

four radiant electric heating elements;

a thermal cut-out device; and means associated with the thermal cut-out device adapted to connect the four heating elements in parallel with each other to give a first power level setting, which in the event of the thermal cut-out device detecting a first predetermined temperature is adapted to connect the heating elements in a lower power configuration in which the elements are connected as two elements connected in series with each other and connected in series with a pair of elements connected in parallel with each other, and which when the thermal cut-out device subsequently detects a second predetermined temperature lower than the first predetermined temperature is adapted to reconnect the heating elements in the configuration of the first power level setting.

In addition to extending the service life, the radiant electric heater assembly according to the present invention can also enable at least one of the heating elements to be energised at all times giving a visual indication that the heater is on.

The means associated with the thermal cut-out device may include switch means for selecting between the configuration of the first power level setting and a second, lower, power level setting in which the heating elements are connected as two elements connected in parallel with each other and connected in parallel with two elements connected in series with each other and which in the event of the thermal cut-out device detecting the first predetermined temperature is adapted to connect the heating elements in a lower power configuration in which the four elements are connected in series with each other, and which when the thermal cut-out device subsequently detects the second predetermined temperature is adapted to reconnect the heating elements in the configuration of the second power level setting.

The two heating elements which are connected in series with each other in the lower power configuration of the first power level setting preferably correspond to the two heating elements which are connected in parallel with each other in the higher power level configuration of the second power level setting.

The electric heating elements are preferably in the form of infra-red lamps.

For a better understanding of the present invention and to show more clearly how it may be carried into effect reference will now be made, by way of example, to the accompanying drawings in which:

BRIEF DESCRIPTION OF THE DRAWINGS

FIG. 5 shows the switch positions for each power level setting of the arrangement shown in FIG. 4.

DESCRIPTION OF PREFERRED EMBODIMENTS

Figure 1:
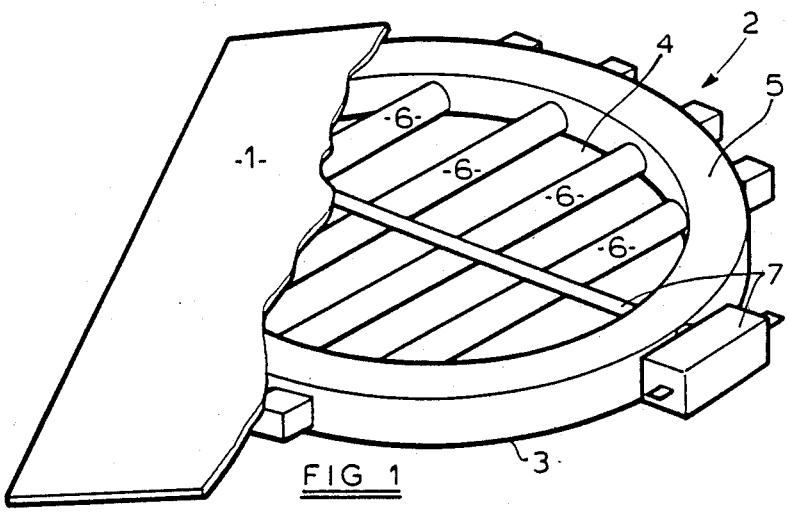
FIG. 1 is a perspective view, partly cut away, of a radiant electric heater assembly arranged beneath a glass ceramic cooking surface.

FIG. 1 shows a known radiant electric heater 2 arranged beneath a glass ceramic cooking surface 1. The heater comprises a dish 3, for example made of metal, the dish containing a base layer 4 of thermal and electrical insulation material such as a microporous material sold under the Registered Trade Mark MICROTHERM. A peripheral wall 5, for example of ceramic fibre material, extends around the internal periphery of the dish 3. Four heating elements 6 in the form of infra-red lamps extend above the base layer 4 and a thermal cut-out device 7 in the form of a probe-type differential expansion switch extends between the heating elements 6 and operates to disconnect the heating elements from a source of electrical energy (not shown) should the probe of the thermal cut-out device exceed a first predetermined temperature so as to protect the glass ceramic cooking surface from excessive temperatures. After the thermal cut-out device has operated to disconnect the source of electrical energy the temperature will decrease and at a second predetermined temperature, lower than the first predetermined temperature, the thermal cut-out device will operate to connect the source of electrical energy once again.

Figure 2:
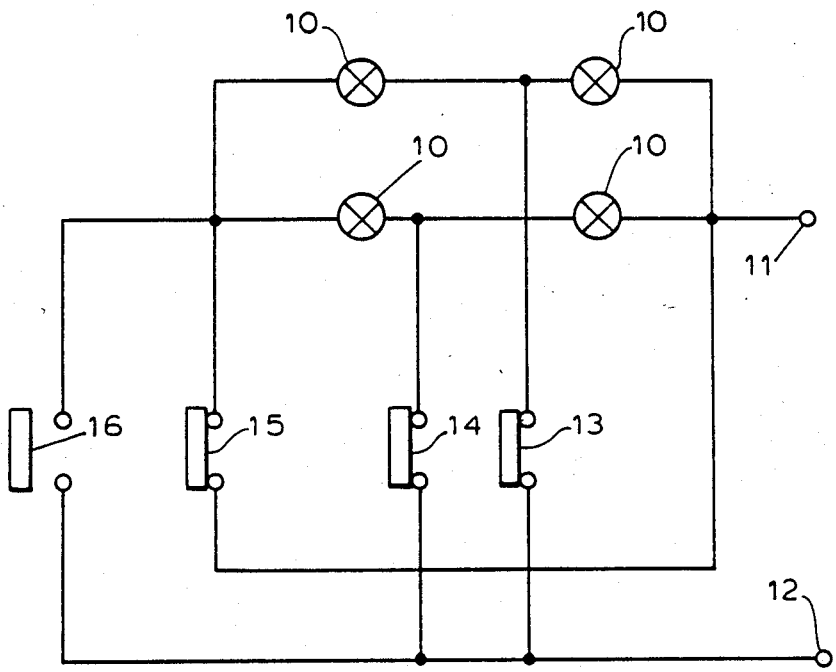
FIG. 2 is a circuit diagram illustrating one embodiment of a radiant electric heater assembly according to the present invention.

In the embodiment of the radiant electric heater assembly according to the present invention illustrated by the circuit diagram of FIG. 2 there are four heating elements 10 in the form of infra-red lamps which may be rated at, for example, 1000 watts each and which are arranged in a heater dish having a diameter of for example 300mm. Different power settings for the heater can be obtained in a number of ways. For example in one embodiment the different power levels can be obtained by a switch which connects the lamps in various parallel and series configurations, the configuration shown in FIG. 2 corresponding to full power. Alternatively, the different power levels of the heater can be obtained by connecting connections 11 and 12 of the heater shown in FIG. 2 to a suitable control device such as an electronic phase control or mark-to-space ratio regulator. The thermal cut-out device incorporates four sets of contacts 13,14,15 and 16. However, in practice, only contacts 13 and/or 14 need to be incorporated into the thermal cut-out device and the remaining contacts 15,16 and possibly 14 or 13 can be incorporated into one or more separate relays which can be triggered by the opening or closing of the contacts 13 and/or 14. When the heater is first energised the thermal cut-out device is in its normal position and allows current to pass to the lamps 10 which in the full power configuration illustrated are connected in parallel with each other. Contacts 13,14 and 15 are closed in this configuration.

If the temperature of the probe of the thermal cut-out device exceeds a first predetermined value the cut-out device operates, not to disconnect all of the heating elements from the source of electric power, but to open the contacts 13,14 and 15 and to close contacts 16. This connects the lamps in a configuration in which two lamps are connected in series and are connected in parallel to the remaining two lamps which are also connected in series. This reduces the power to substantially 34 per cent of full power and allows the temperature of the glass ceramic to fall and the temperature of the probe of the thermal cut-out device to fall to a second predetermined temperature at which the contacts 16 are opened and the contacts 13,14 and 15 are closed to restore full power to the heating elements.

It is important in this embodiment that the contacts 15 should open prior to the closing of the contacts 16 and that the contacts 16 should not close until after any arc caused by the opening of the contacts 15 is extinguished. Similarly the contacts 16 should open and any arc should be extinguished before the contacts 15 close. The timing of the opening and closing of the contacts 13 and 14 is not critical.

We have found that, in circumstances where heat is not dissipated from the cooking surface 1 quickly enough to avoid overheating, the arrangement whereby the action of the thermal cut-out device reduces the power of the lamps rather than disconnecting all power to the lamps reduces the number of times the thermal cut-out device switches in a given period and thus increases the useful life of its contacts. Moreover, for any given period during which the heater is energised the lamps 10 will run at full power for a lower proportion of the time. This leads to an increased service life for the lamps. Nevertheless, for the embodiment of the invention described with reference to FIG. 2 it is vital that the contacts 15 should open before the contacts 16 close and that the contacts 16 should open before the contacts 15 close.

Figure 3:
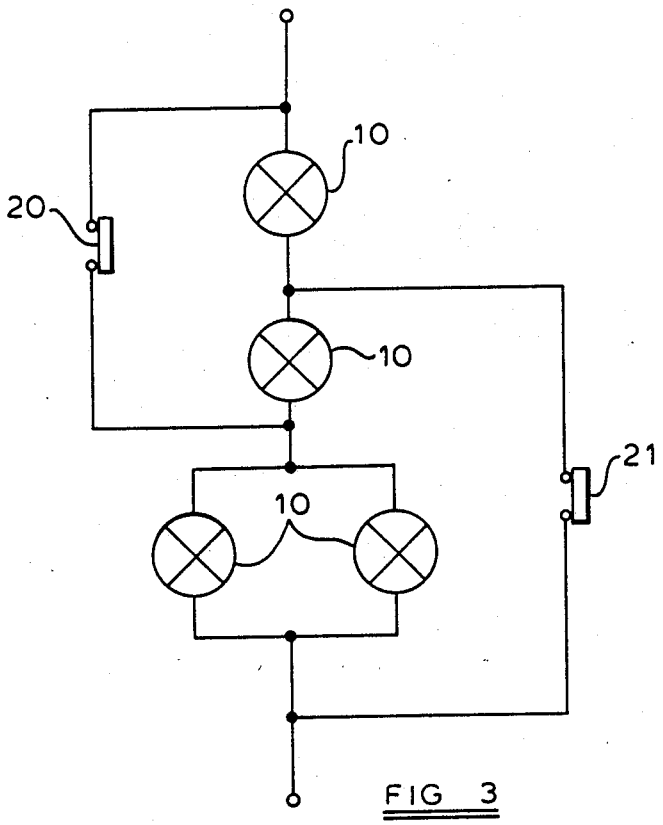
FIG. 3 is a circuit diagram illustrating another embodiment of a radiant electric heater assembly according to the present invention.

In the embodiment of the radiant electric heater assembly according to the present invention illustrated by the circuit diagram of FIG. 3 there are four heating elements 10 as with the embodiment of FIG. 2. The configuration shown in FIG. 3 corresponds to full power while the contacts 20,21 of the thermal cut-out device are closed.

If the temperature of the probe of the thermal cut-out device exceeds a first predetermined value the thermal cut-out device operates to open the contacts 20,21 and thus to connect two of the lamps (the lower pair in the Figure) in parallel with each other and the remaining lamps (the upper pair) in series with the parallel pair. This reduces the power to substantially 18 per cent of full power and allows the temperature of the glass ceramic to fall and the temperature of the probe of the thermal cut-out device to fall to a second predetermined temperature at which the contacts 20, 21 close to restore full power to the heating elements.

With this embodiment, in addition to increasing the service life of the lamps and the contacts, the timing of the opening and closing of the contacts is not crucial because no short circuit configuration can exist. The contacts 21 carry the current of three lamps whereas the contacts 20 carry the current of only two lamps.

In practice it is not necessary for both contacts 20,21 to be incorporated into the thermal cut-out device and either set or both sets of contacts could be incorporated into a separate relay.

Other configurations are also possible.

Figure 4:
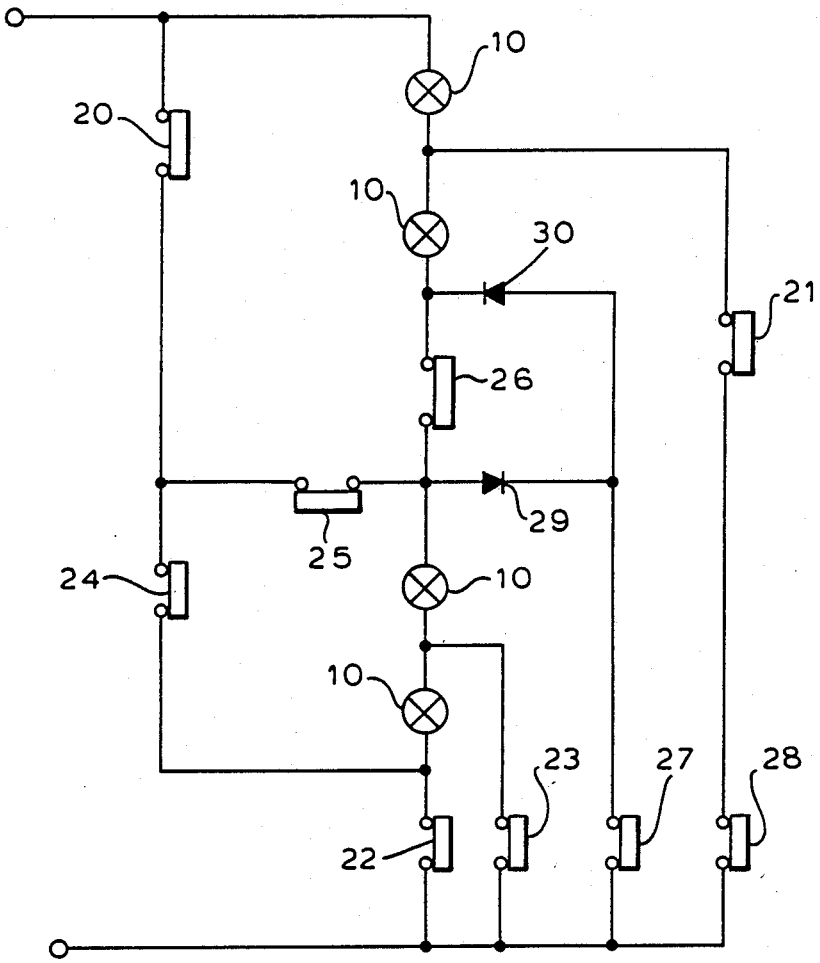
FIG. 4 is a circuit diagram showing in more detail the circuit diagram of FIG. 3.

Although for simplicity we have described above the power being reduced only from full power to a lower power configuration, and indeed for heater control by phase control or mark-to-space ratio regulators no further configuration may be needed. However, for heater control by multi-position switch it is also possible to connect the heating elements so that in the event of the thermal cut-out device having detected a temperature which exceeds the first predetermined value and with the multi-position switch set to any intermediate power setting the heating elements are connected in a lower power configuration or the same power configuration where the heater power setting is low. This is illustrated in FIG. 4 in which the same reference numerals as those used in FIG. 3 are employed to denote the same components. FIG. 4 shows a more complete circuit diagram in which the contacts 20, 21 are used to connect the lamps 10 in a lower power configuration at a number of power level settings if the temperature of the probe of the thermal cut-out device exceeds a first predetermined value. FIG. 4 also shows contacts 22, 23, 24, 25, 26, 27 and 28 which are incorporated into a multi-position switch and which in co-operation with diodes 29 and 30 are used to connect the lamps in six different configurations giving six different power levels plus an off setting. The power levels are level 1 with all four lamps connected in series with each other and with both diodes (7 per cent of full power), level 2 with all four lamps connected in series (12 per cent of full power), level 3 with two pairs of lamps connected in series with each other and with a diode, the two pairs being connected in parallel such that the diodes conduct in alternate half cycles of the power supply (20 per cent of full power), level 4 with two pairs of lamps connected in series with each other, the two pairs being connected in parallel and supplied via parallel opposite-poled diodes (34 per cent of full power), level 5 with two lamps (the lower pair in FIG. 4) connected in series, the two lamps being connected in parallel with the remaining two lamps (67 percent of full power) and level 6 in which all four lamps are connected in parallel (100 per cent of full power). FIG. 5 shows which of the contacts 22–28 should be open and which should be closed to give any particular power level. At levels 1 and 2 it is considered unnecessary to switch to a lower power configuration should the temperature of the probe of the thermal cut-out device exceed the first or second predetermined values because this situation should only arise if the level is changed from a high level to a lower level while the temperature is in excess of one of the said values and will quickly fall to below the second predetermined value. At level 3 the contacts 20, 21 co-operate to connect the lamps so that two lamps (the upper pair in FIG. 4) are connected in series with each other and with the diode 30 in the event of an excessive temperature, the remaining two lamps being de-energised. Similarly at level 4 the contacts 20, 21 co-operate to connect two lamps (again the upper pair in FIG. 4) in series with each other in the event of an excessive temperature with the remaining two lamps being de-energised. At level 5, the contacts 20, 21 co-operate to connect the four lamps in series with each other in the event of an excessive temperature, while level 6 has already been described in connection with FIG. 3. It can be seen that the lamps which carry a higher current in normal operation at level setting 5 (the upper pair in FIG. 4) are the same as the lamps which carry all the current at level setting 6 with the limiter contacts open (though they are then connected in series). This facilitates arrangement of the lamps to provide an aesthetically pleasing appearance at different power settings and states of limiter operation.

I claim:

1. A radiant electric heater assembly for a glass ceramic top cooker comprising:

a glass ceramic cooking surface;

four radiant electric heating elements;

a thermal cut-out device for protecting the glass ceramic cooking surface from excessive temperatures; and means associated with the thermal cut-out device adapted to automatically connect the four heating elements in parallel with each other to give a first power level setting, which in the event of the thermal cut-out device detecting a first predetermined temperature is adapted to automatically connect the heating elements in a lower power configuration in which the elements are connected as two elements connected in series with each other and connected in series with a pair of elements connected in parallel with other, and which when the thermal cut-out subsequently detects a second predetermined temperature lower than the first predetermined temperature is adapted to automatically reconnect the heating elements in the configuration of the first power level setting.

2. A radiant electric heater assembly according to claim 1, wherein the means associated with the thermal cut-out device includes switch means for selecting between the configuration of the first power level setting and a second, lower, power level setting in which the heating elements are connected as two elements connected in parallel with each other and connected in parallel with two elements connected in series with each other and which in the event of the thermal cut-out device detecting the first predetermined temperature is adapted to automatically connect the heating elements in a lower power configuration in which the four elements are connected in series with each other, and which when the thermal cut-out device subsequently detects the second predetermined temperature is adapted to automatically reconnect the heating elements in the configuration of the second power level setting.

3. A radiant electric heater assembly according to claim 2, wherein the two heating elements which are connected in series with each other in the lower power configuration of the first power level setting correspond to the two heating elements which are connected in parallel with each other in the higher power level configuration of the second power level setting.

4. A radiant electric heater assembly according to claim 1, wherein the electric heating elements are in the form of infra-red lamps.

* * * * *